US012116873B2

(12) United States Patent
Alves Sao Mateus et al.

(10) Patent No.: US 12,116,873 B2
(45) Date of Patent: Oct. 15, 2024

(54) PNEUMATIC LIFTING SYSTEM FOR HYDROCARBON PRODUCTION

(71) Applicant: PETRÓLEO BRASILEIRO S.A.—PETROBRAS, Rio de Janeiro (BR)

(72) Inventors: Carlos Alberto Alves Sao Mateus, Aracaju (BR); Daniel Centurion Barrionuevo, Niterói (BR); Alcino Resende De Almeida, Rio de Janeiro (BR); Ricardo Dos Santos Fraga, Rio de Janeiro (BR)

(73) Assignee: PETRÓLEO BRASILEIRO S.A.—PETROBRAS, Rio de Janeiro (BR)

( * ) Notice: Subject to any disclaimer, the term of this patent is extended or adjusted under 35 U.S.C. 154(b) by 283 days.

(21) Appl. No.: 17/269,774

(22) PCT Filed: Aug. 8, 2019

(86) PCT No.: PCT/BR2019/050322
§ 371 (c)(1),
(2) Date: Jul. 14, 2021

(87) PCT Pub. No.: WO2020/037386
PCT Pub. Date: Feb. 27, 2020

(65) Prior Publication Data

US 2022/0268138 A1 Aug. 25, 2022

(30) Foreign Application Priority Data

Aug. 20, 2018 (BR) ..... 102018016996-3

(51) Int. Cl.
*E21B 43/12* (2006.01)

(52) U.S. Cl.
CPC ..... *E21B 43/123* (2013.01)

(58) Field of Classification Search
CPC .... E21B 43/12; E21B 43/123; E21B 43/1235; E21B 43/13
See application file for complete search history.

(56) References Cited

U.S. PATENT DOCUMENTS

RE32,441 E * 6/1987 Higgins ..... E21B 43/123 228/168
5,535,828 A 7/1996 der Kinderen et al.
(Continued)

FOREIGN PATENT DOCUMENTS

CN 101979823 A 2/2011
EP 0 745 176 A1 12/1996
(Continued)

*Primary Examiner* — Kristyn A Hall
(74) *Attorney, Agent, or Firm* — Birch, Stewart, Kolasch & Birch, LLP

(57) ABSTRACT

This invention is related to a pneumatic lifting system for hydrocarbon production, comprising at least one mandrel (1) and at least one gas flow control valve (11), wherein the at least one mandrel (1) is connected to a production string (3), wherein the production string is positioned inside a well casing (2), wherein it comprises a straddle (10) supported on the production string and enveloping the mandrel, wherein in the region of the gas outlet (110) of the gas flow control valve (11) a chamber (105) is formed, wherein the straddle (10) comprises a means of fluidic communication (102) adapted to feed gas inside the straddle (10).

17 Claims, 2 Drawing Sheets

(56) References Cited

U.S. PATENT DOCUMENTS

| | | | | |
|---|---|---|---|---|
| 2002/0096332 | A1 | 7/2002 | De Almeida | |
| 2005/0061369 | A1 * | 3/2005 | De Almeida | E21B 43/123<br>137/155 |

FOREIGN PATENT DOCUMENTS

| | | | |
|---|---|---|---|
| EP | 1 686 235 | B1 | 1/2008 |
| WO | WO 95/22682 | A1 | 8/1995 |
| WO | WO 2014/039740 | A1 | 3/2014 |

* cited by examiner

PNEUMATIC LIFTING SYSTEM FOR HYDROCARBON PRODUCTION

FIELD OF THE INVENTION

This invention is in relation to side pocket mandrels used to house gas flow control valves in gas-injection oil lifting systems, known as gas lift.

BACKGROUND OF THE INVENTION

Many hydrocarbon production processes (mainly for oil) make use of artificial lifting systems to help lift production from the reservoir up to the processing facilities.

One of the processes most often used is pneumatic lifting, better known as gas lift, which is a term in English widely used by those knowledgeable in the area.

In a very common configuration for this method, highly pressurized natural gas is injected into an annular space 5 between the casing pipe and the production pipe. Additionally, flow control devices known as pneumatic lifting valves (or pneumatic pumping valves), also known as gas lift valves, are positioned at specific points on the production pipe.

The purpose of these valves is to control the flow of pressurized gas that flows through the annular space to the inside of the production pipe, in order to maintain the desired flow rate inside the production pipe.

In this method, after the pressurized gas is injected inside the production pipe it is expanded, reducing the apparent density of the mixture that flowed through the production pipe, which facilitates its flow.

This method may be used continuously (continuous pneumatic lifting) or intermittently (intermittent pneumatic elevation).

In the continuous mode, gas is continuously injected along the production pipe, at the points where the pneumatic pumping valves are positioned. Usually, gas injection is controlled by using a choke valve located on the surface and a second valve (pneumatic blocking valve) located at the injection point.

In the intermittent mode, the gas is injected at positions along the production pipe where pneumatic pumping valves are allocated by a certain interval of time. In this mode, the cycle is divided into two periods, one rest and feed period, and one final production period.

In the rest and feed period, the fluid that comes from the reservoir fills the production pipe, then the gas is injected through the pneumatic blocking valves.

In the final production period, the fluid produced reaches the collection point and the collection system is depressurized. At this point, a new rest and feed period is begun.

In both cases, the valves that control the gas injection are housed in pneumatic pumping mandrels (gas lift mandrels). A very common type of these mandrels is known as a side pocket mandrel, in which the valve is housed inside a lateral pocket in order not to reduce the cross section of the production pipe at that point.

However, an inconvenience that is found in the majority of pneumatic lifting systems in the state-of-the-art is that the gas ends up being injected against the main flow coming from the reservoir, with the objective of providing a better mixture of the gas with the liquid being produced. However, this causes an unnecessary loss in local pressure, which is reflected in a loss of flow of the production liquid.

Document EP1686235 (B1) illustrates a gas lift system for use in oil wells that comprises a side pocket mandrel with a side pocket and a single-direction valve in the side pocket that prevents fluid from inside the mandrel flowing outside of the mandrel.

Document EP745176 (A1) reveals a system for inserting injection fluid in a flow of hydrocarbon fluid that includes gas lift to cause the hydrocarbon flow to flow in a well. In that document, gas is injected against the current, as shown in the figures.

Document WO2014039740 (A1) reveals a gas lift valve to control the flow of gas during an intermittent gas lift operation in an undersea well, in which the valve comprises an element to allow the flow through it in just one direction. The document focuses specifically on the valve and clearly directs the injected gas against the production flow.

Document CN101979823 (A) reveals, among other elements, a gas lift system integrated with a production string used to help lift the liquid that comes from a well. The gas lift system in that document is positioned in a side pocket, and comprises gas injection into the production string by means of a horizontal duct.

However, no document in the state-of-the-art makes any reference to the use of a gas injection lift system that allows the gas not to be injected against the flow inside the production string.

One alternative to resolve this problem is revealed in document PI 0300958-0, in which a modification to the geometry of the mandrel is proposed so that the gas is inserted at an angle that is not against the production flow.

However, this solution does not allow the gas to be inserted homogeneously, which shows a second inconvenience in the state-of-the-art.

Therefore, it is clear that the state-of-the-art lacks a pneumatic pumping system that allows gas to be injected in a manner that is not contrary to the production flow, and that still allows good homogenization of the production flow with the injected gas.

SUMMARY OF THE INVENTION

The principal objective of this invention is to provide a pneumatic lifting system for hydrocarbon production, wherein the lift gas is not injected against the flow of the fluid inside the production pipe, but in which, at the same time, the gas is mixed homogeneously with the hydrocarbon produced.

Therefore, in order to attain that objective, this invention provides a pneumatic lifting system for hydrocarbon production, comprising at least one mandrel and at least one gas flow control valve, wherein the at least one mandrel is connected to a production string, wherein the production string is positioned inside a well casing, wherein the system comprises a straddle supported on the production string and enveloping the mandrel, wherein in the region of the gas outlet from the gas flow control valve a chamber is formed, wherein the straddle comprises a means of fluidic communication adapted to feed gas inside the straddle.

BRIEF DESCRIPTION OF THE FIGURES

The detailed description presented below references the annexed figures and their respective reference numbers, representing the methods of this invention.

DETAILED DESCRIPTION OF THE INVENTION

First, it is noted that the description that follows will start with a preferred embodiment of the invention, applied to a pneumatic lifting system for production of hydrocarbons. As will become evident to any expert in the matter, however, the invention is not limited to that particular embodiment.

Figure 1:
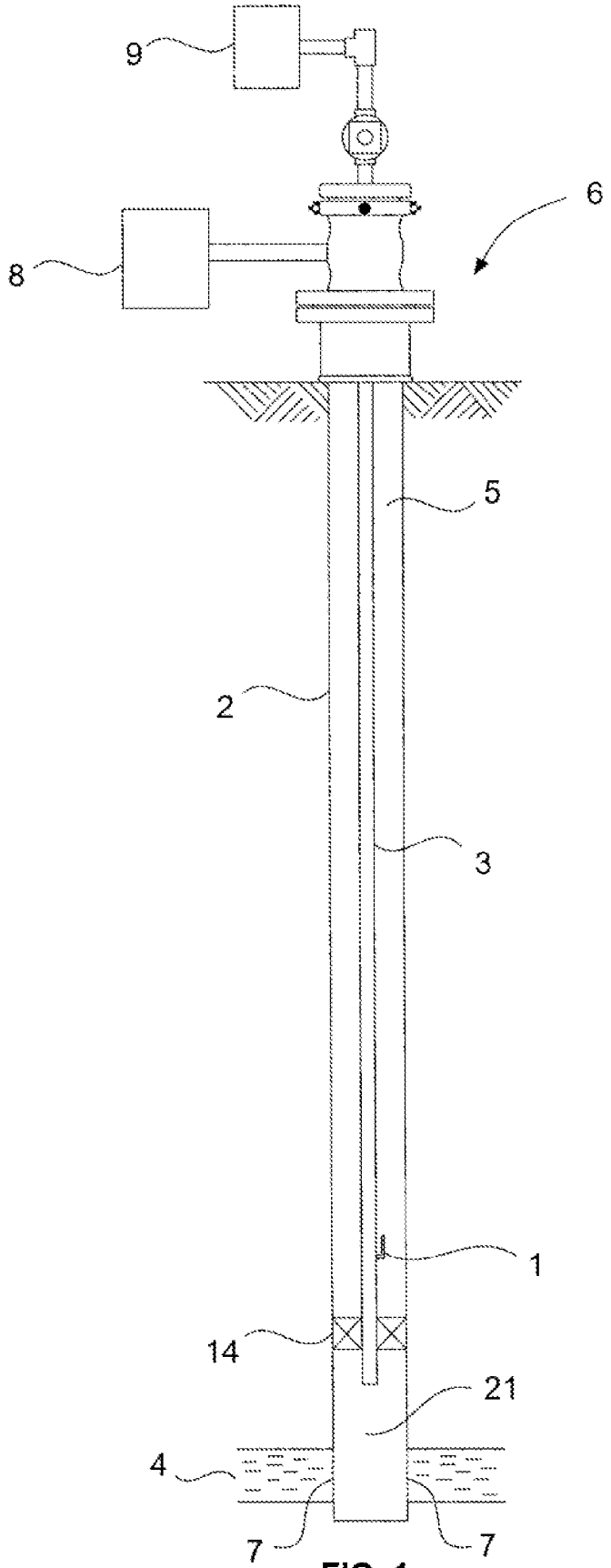
FIG. 1 shows a side view of an oil well that comprises a pneumatic lifting system for production of hydrocarbons as described by this invention.

FIG. 1 shows a schematic view of a pneumatic lifting system for hydrocarbon production from an oil well. The illustrated system comprises a well casing 2 with a production string 3 in its interior.

Optionally, a packer 14 is installed between the production string 3 and the well casing 2, at a point close to the oil reservoir 4, creating an annular space 5 between the well casing 2 and the production string 3, wherein that chamber is sealed down low by a packer 14, and up above by a wellhead 6, widely known in the state-of-the-art by the term in English wellhead.

During production from the well, the fluids from the reservoir 4 enter into a lower area of the well 21 through openings 7 formed in the well and they are run through the production string 3 to the wellhead 6, from where they are redirected to processing facilities 8. That system as a whole is widely known in the current state-of-the-art, therefore, for the purpose of providing a concise description, details of that system will not be included, which will in no way hinder understanding by any expert in the area.

During the pneumatic lifting process in hydrocarbon production, an external source of high-pressure gas 9 injects highly pressurized gas into the annular space 5 between the casing 2 and the production string 3. That gas is then injected inside the production string 3 by a gas flow control valve 11 positioned on a pneumatic pumping mandrel 1.

Then the injected gas is mixed into the flow coming from the reservoir 4, reducing its apparent density and causing the fluid to be run more easily towards the wellhead 6.

As already discussed in the section FOUNDATIONS OF THE INVENTION, the pneumatic lifting process may be continuous or intermittent. However, the basic process in both cases is that described in the previous paragraph.

It is noted that although FIG. 1 is shown with just one mandrel 1 for installation of the pneumatic pumping valve 11, the number of valves used may vary substantially from one valve up to a plurality of valves, in which the valves may act differently among themselves.

The wells in which the described system is used may be onshore or offshore. Offshore, the wells may have wellhead equipment 6, and dry or wet completion.

The mandrel 1 that is preferably used is a side pocket mandrel. This mandrel 1, one of those most used in the state-of-the-art, comprises a lateral space (pocket) where the gas flow control valve 11 is positioned. Thus, the area from the section of the production string 3 where the valve 11 is positioned is not reduced, which may be a disadvantage in conventional mandrels (without a side pocket).

However, the invention that will be described below may be used both with side pocket mandrels 1, as well as conventional mandrels 104, as well be obvious to any expert in the matter.

Figure 2:
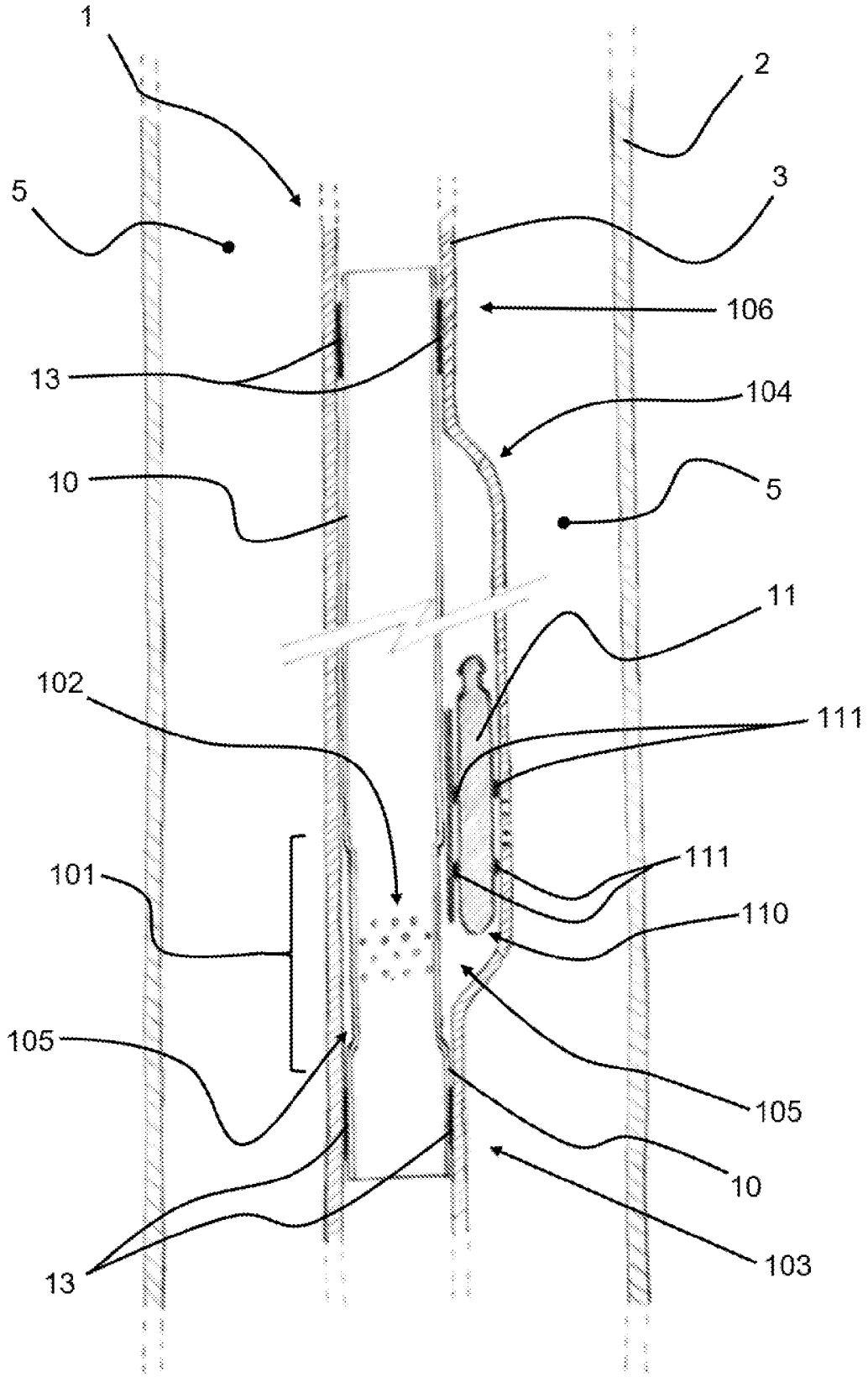
FIG. 2 shows a side view of the detail of the mandrel of the pneumatic lifting system for production of hydrocarbons as described of this invention.

FIG. 2 shows a side view of the detail of the mandrel 1 of the pneumatic lifting system for production of hydrocarbons of this invention. In this detail, it can be seen that the system comprises a straddle 10 supported on the production string 3 and enveloping the mandrel 1, wherein a chamber 105 is formed in the gas exit region 110 of the gas flow control valve 11, wherein the straddle 10 comprises at least one means of fluidic communication 102 adapted to feed gas inside the straddle 10.

With use of the straddle 10, the hydrocarbon flow does not come into contact with the gas flow control valve 11, since the entire flow that runs through the production string 3 passes inside the straddle 10 along the entire length of the mandrel 1, until returning to the production string 3 after the mandrel 1. Thus, the gas is not injected against the hydrocarbon flow, but into the chamber 105 formed in the region of the gas outlet 110.

Therefore, in accordance with this invention, the pressurized gas, located inside the annular space 5 between the well casing 2 and the production string 3, feeds the gas flow control valve 11, which is positioned with the help of gaskets 111, which cause all of the gas to be directed towards the gas flow control valve 11, which redirects the gas to the gas outlet area 110 of the valve 11. At least in that region (gas outlet region 110 of the gas flow control valve 11), the straddle 10 comprises a means of fluidic communication 102 adapted to feed gas inside the straddle 10. Optionally, the means of fluidic communication 102 is a plurality of openings that communicate fluidically to the chamber 105 formed with the interior of the straddle 10.

Thus the gas directed towards the chamber 105 is injected inside the straddle 10 through the fluidic communication means 102 (plurality of orifices), in order to provide a better mixture of the gas with the flow of hydrocarbons.

Thus, this invention solves the two mentioned problems in the state-of-the-art. The gas is not injected against the hydrocarbon flow, since it is injected into the chamber 105. Additionally, the means of fluidic communication 102 ensures that the gas is inserted in such a way as to provide an efficient mixture of the gas in the hydrocarbon fluid.

Optionally, as shown, the mandrel 1 is a side pocket mandrel 1. However, although FIG. 2 only shows that configuration, it will be obvious to an expert in the matter that the mandrel 1 used in specific embodiments of the invention may be a conventional mandrel 1 or a side pocket mandrel 1.

Optionally, in the gas outlet region 110 of the gas flow control valve 11, a annular chamber 105 is formed, delimited by the straddle 10 and by the side pocket mandrel 1. In this case, a configuration may be used wherein, in the gas outlet region 110 of the gas control valve 11, at least one portion of the straddle 10 comprises a reduced cross section 101 in relation to its extremities. That narrowing 101 of the straddle 10 would form a annular chamber 105 in that region, such that increasing the area of the straddle 10 wherein the means of fluidic communication 102 is used, also increases homogenization of the gas with the hydrocarbon flow.

Also optionally, the system may comprise sealing elements 13 positioned between the straddle 10 and the production string 3, wherein at least one sealing element 13 is positioned close to the upper end 106 of the straddle and at least one sealing element 13 is positioned close to the lower end of the straddle 103, in order to prevent the escape of gas or hydrocarbon leaks, reinforcing the watertightness of the chamber 105 formed.

The system of this invention also has the advantage that it may be used with pneumatic lifting systems that have already been installed. In these cases, the straddle 10 could be seated as such components are normally seated, or the column could be provided with seating nipple(s) immediately above or below the mandrel 1.

The design of the mandrel 1 could also be adapted to anticipate the seating of these devices in the region of the side pocket 104.

The straddle 10 could be installed in already-existing gas lift wells by means of operation with a wire, or it could be dropped directly, and seated on the column in new installations.

Therefore, in summary, this invention provides a pneumatic lifting system for hydrocarbon production, comprising at least one mandrel 1 and at least one gas flow control valve 11, wherein the at least one mandrel 1 is connected to a production string 3, wherein the production string 3 is positioned inside a well casing 2, wherein the system comprises a straddle 10 supported on the production string 3 and enveloping the mandrel 1, wherein in the region of the gas outlet 110 from the gas flow control valve 11 a chamber 105 is formed, wherein the straddle 10 comprises a means of fluidic communication 102 adapted to feed gas inside the straddle 10.

The invention claimed is:

1. A pneumatic lifting system for hydrocarbon production, comprising at least one mandrel and at least one gas flow control valve, wherein the at least one mandrel is connected to a production string, wherein the production string is positioned inside a well casing, wherein the pneumatic lifting system further comprises a straddle supported on the production string by using sealing elements disposed within the production string, wherein in the region of gas outlet of the gas flow control valve a annular chamber is formed, wherein the straddle comprises a means of fluidic communication adapted to feed gas inside the straddle, wherein in the region of the gas outlet from the gas flow control valve at least one portion of the straddle comprises a reduced cross-section area in relation to the straddle ends.

2. The system of claim 1, wherein the means of fluidic communication adapted to feed gas inside the straddle comprises a plurality of orifices.

3. The system of claim 2, wherein in the region of the gas outlet from the gas flow control valve the annular chamber is delimited by the straddle and by the mandrel.

4. The system of claim 2, wherein the sealing elements are positioned between the straddle and the production string, wherein at least one sealing element is positioned close to the upper end of the straddle and at least one sealing element is positioned close to the lower end of the straddle.

5. The system of claim 2, wherein the production string comprises at least one seating nipple immediately above or below the mandrel.

6. The system of claim 2, wherein the mandrel is a side pocket mandrel.

7. The system of claim 1, wherein in the region of the gas outlet from the gas flow control valve the annular chamber is delimited by the straddle and by the mandrel.

8. The system of claim 7, wherein the sealing elements are positioned between the straddle and the production string, wherein at least one sealing element is positioned close to the upper end of the straddle and at least one sealing element is positioned close to the lower end of the straddle.

9. The system of claim 7, wherein the production string comprises at least one seating nipple immediately above or below the mandrel.

10. The system of claim 7, wherein the mandrel is a side pocket mandrel.

11. The system of claim 1, wherein the sealing elements are positioned between the straddle and the production string, wherein at least one sealing element is positioned close to the upper end of the straddle and at least one sealing element is positioned close to the lower end of the straddle.

12. The system of claim 11, wherein the production string comprises at least one seating nipple immediately above or below the mandrel.

13. The system of claim 1, wherein the production string comprises at least one seating nipple immediately above or below the mandrel.

14. The system of claim 1, wherein the mandrel is a side pocket mandrel.

15. The system of claim 1, wherein the sealing elements are positioned between the straddle and the production string, wherein at least one sealing element is positioned close to the upper end of the straddle and at least one sealing element is positioned close to the lower end of the straddle.

16. The system of claim 1, wherein the production string comprises at least one seating nipple immediately above or below the mandrel.

17. The system of claim 1, wherein the mandrel is a side pocket mandrel.

* * * * *